United States Patent [19]

Feher

[11] Patent Number: 4,910,498

[45] Date of Patent: Mar. 20, 1990

[54] SWIMMING POOL SAFETY ALARM

[76] Inventor: Steve Feher, 1909 Aleo Pl., Honolulu, Hi. 56822

[21] Appl. No.: 196,026

[22] Filed: May 19, 1988

[51] Int. Cl.[4] ..... G08B 13/18

[52] U.S. Cl. ..... 340/556; 250/221; 340/539; 340/573; 340/693

[58] Field of Search ..... 340/556–557, 340/539, 693, 636, 566, 573; 250/221, 349, 353; 350/602, 617, 618, 622

[56] References Cited

U.S. PATENT DOCUMENTS

| | | | |
|---|---|---|---|
| 3,623,057 | 11/1971 | Hedin et al. | 340/557 |
| 3,688,298 | 8/1972 | Miller et al. | 340/557 |
| 3,711,846 | 1/1973 | Schlisser et al. | 340/557 |
| 4,384,280 | 5/1983 | Haag | 340/556 |
| 4,701,751 | 10/1987 | Sackett | 340/556 |
| 4,740,775 | 4/1988 | Price | 340/539 X |
| 4,757,304 | 7/1988 | Rho | 340/539 X |
| 4,761,638 | 8/1988 | Lozano, Jr. | 340/620 |
| 4,775,854 | 10/1988 | Cottrell | 340/566 |

*Primary Examiner*—Glen R. Swann, III
*Assistant Examiner*—Thomas J. Mullen, Jr.
*Attorney, Agent, or Firm*—George J. Netter

[57] ABSTRACT

An infrared light emitter forms a beam of infrared (IR) light directed onto a set of mirrors or reflecting surfaces arranged to form a closed path about a swimming pool and spaced above the pool deck a sufficient amount so as to be intercepted by anyone who might walk through it. After the reflected beam has traversed the closed path about the pool, it then impinges upon a light detector. An electric circuit provides a continuous alarm which can either be sound or visual upon beam interruption and which must be manually reset before it becomes inactive. The monitoring system may be actuated so the operative state by a handheld radio frequency transmitter. Electrical power for the system can be a rechargeable battery which is recharged by a solar array mounted directly onto a part of the system obviating the need for interconnecting cable wiring.

4 Claims, 2 Drawing Sheets

FIG. 5
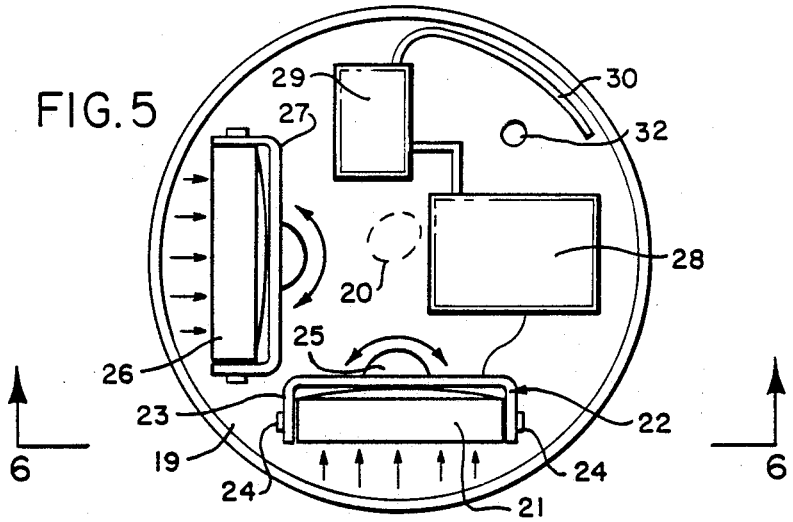
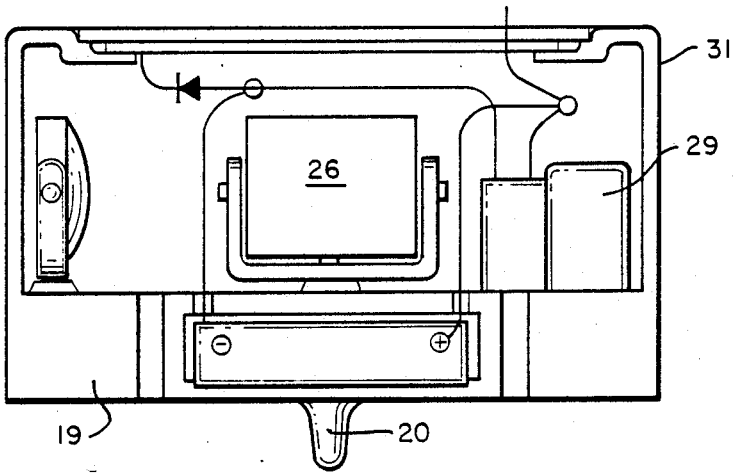
FIG. 6
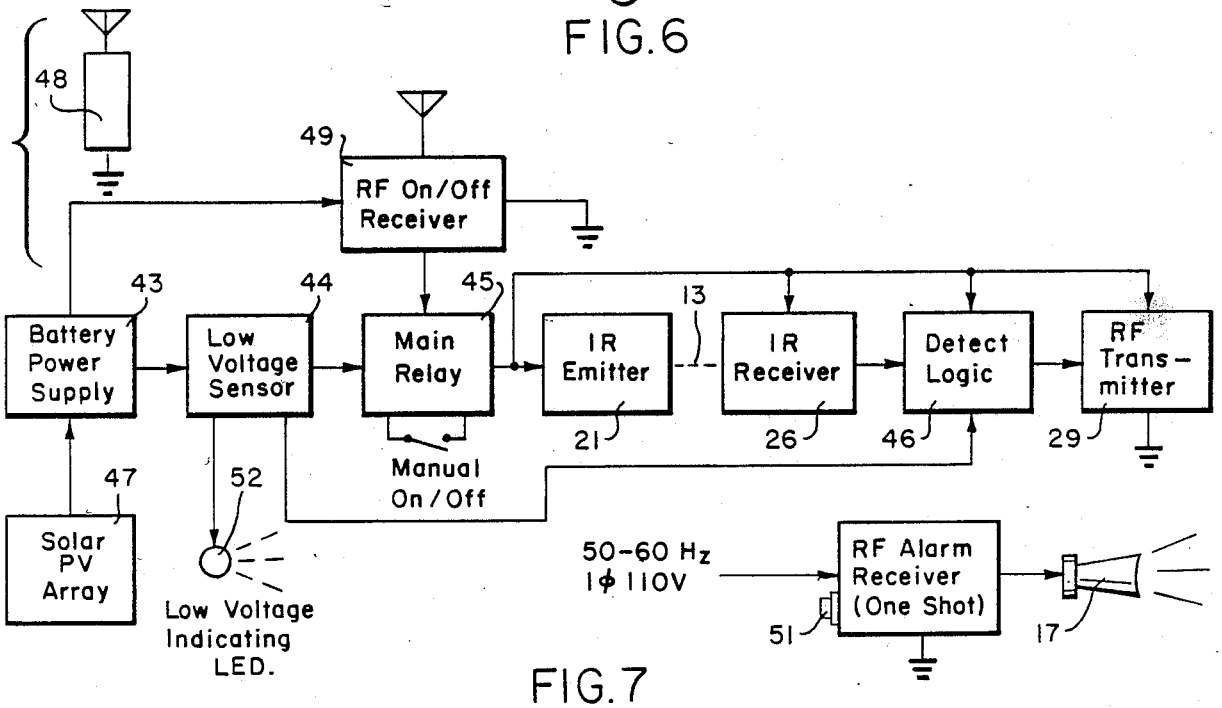
FIG. 7

SWIMMING POOL SAFETY ALARM

The present invention relates generally to a safety alarm system for a swimming pool, and, more particularly, to such an alarm system giving an identifiable signal when an individual (e.g., young child) either falls into the pool or is closely adjacent the edge of the pool and in danger of falling into the pool

BACKGROUND OF THE INVENTION

Despite local ordinances requiring fencing and locked gates for swimming pools and the immediately adjacent areas, there are an alarmingly high number of deaths and brain damage occurring to young children who fall into the pools when no one is around to assist them. Young children are irresistibly attracted to a swimming pool and are known to climb over fences and to otherwise make their way to the pool and adjacent area so that there is a continuing possibility of danger to children in the neighborhood of a pool owner One known system for detecting an intruder (e.g., child) in the area of a swimming pool utilizes a passive infrared system which detects infrared energy emitted from the human body anywhere within a certain predetermined detection range and responsive to such detection transmits a radio frequency signal to a receiver which actuates a suitable alerting means Such a system is sold under the trade designation Poolside Alert, OPA-100, manufactured and distributed by Optex U.S.A., Inc. of Torrance, Calif.

One major difficulty with passive infrared systems is that the sensed infrared energy can come from a great variety of sources other than a human intruder, such as, for example, sunshine directly impinging upon the sensor, reflected light, or a barbecue or grill in the vicinity, for example Also, to provide full protection where a pool has access from all sides it may be necessary to provide four sets of detectors and possibly four separate power supplies to achieve full protection

SUMMARY OF THE INVENTION

In the practice of the present invention there is provided an infrared light emitter which when energized forms a beam of infrared (IR) light The IR beam is directed onto a set of mirrors or reflecting surfaces arranged to form a closed path about the pool spaced above the pool decking a sufficient amount so it can be intercepted by anyone who might walk through it After the reflected beam has traversed the closed path about the pool, it then impinges upon an IR light detector Electric circuit means are provided which when the infrared light beam is intercepted by, say, a child who is unauthorized in the area, they provide a continuous alarm which can either be a sound or visual and which must be manually reset before it becomes inactive Although it is possible to enclose a given swimming pool within an intruder monitoring IR beam by the use of only two reflecting surfaces, in the usual case there will be three such surfaces located at three corners, for example, of the extended pool sides with the electrical apparatus for producing and detecting an IR beam being located at the fourth corner It is contemplated that the IR monitoring system is actuated to the operative state by a handheld radio frequency transmitter Electrical power for the system can be a rechargeable battery which is recharged by a solar array mounted directly onto a part of the system obviating the need for interconnecting cable wiring

DESCRIPTION OF THE DRAWING

FIG. 5 is a top plan sectional view of infrared emitting and detection apparatus of the invention.

FIG. 6 is a side elevational, sectional view taken along the line 6—6 of FIG. 5.

FIG. 7 is a perspective view of an alignment tool used in setting up or adjustably positioning the invention FIG. 8 is an electrical circuit schematic of the apparatus of this invention

DESCRIPTION OF A PREFERRED EMBODIMENT

According to published sources, hundreds of children each year die from accidental drowning in domestic swimming pools in the U.S., or, receive brain damage as a result falling into the pool. These deaths and injuries occur even when there has been compliance with safety ordinances relating to fencing and locking of gates to prevent unauthorized access to swimming pool areas. It is, therefore, a fundamental aim and object of this invention to provide a system which will detect the presence of anyone, including a child, within a predetermined distance of the pool and activate an alarm so that the individual in potential danger can be readily located and removed to safety.

Figure 1:
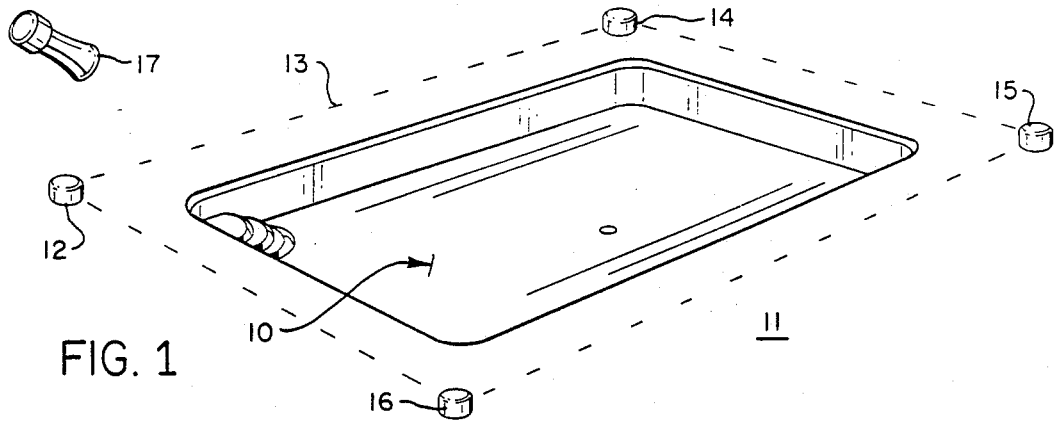
FIG. 1 shows a perspective view of a rectangular swimming pool with the system of the invention operatively related thereto.

Turning now to the drawings and particularly FIG. 1 there is shown a typical generally rectangular swimming pool 10 which is shown surrounded by a relatively flat cement deck 11 on which individuals can walk or from which they can dive into the pool water. The system, which will be more particularly described later, in its major elements includes apparatus 12 fixedly mounted to the deck at a point outwardly of one of the pool corners that on being energized transmits a beam 13 of infrared light along a path above the decking 11 and generally parallel to one of the pool edges. A first reflecting unit 14 located outwardly of a second corner of the pool is so constructed and located as to reflect the infrared light beam from 12 along a path parallel to a second edge of the pool to a point where it is received by a second reflecting unit 15 which, in turn, sends the beam along a path parallel to the further pool edge where it is intercepted by yet another or third corner reflecting unit 16, the latter reflecting unit bringing the beam back to the apparatus 12. The returning beam, after it has traversed the closed path via the reflecting units 14–16, impinges upon an infrared detector mounted within the apparatus 12 which produces an electric signal indicative of the fact that the infrared beam has been produced and that the apparatus is in intrudermonitoring condition. When the light beam 13 is interrupted at any point along its reflected path, this causes an alarm signal to be produced by apparatus 12 activating an alarm 17, which may be audible, visual or both.

It has been found that the best location for the IR monitoring beam 13 is approximately one foot from the pool edge and 2–4 inches above the decking. With the beam so located this permits leaves, bugs, and other foreign matter to blow or roll under the beam without setting off an erroneous alarm However, the beam is sufficiently high so that if a child moves into the range of the beam, it will immediately intercept it with its feet or other parts of the anatomy producing an alarm signal.

Figure 2:
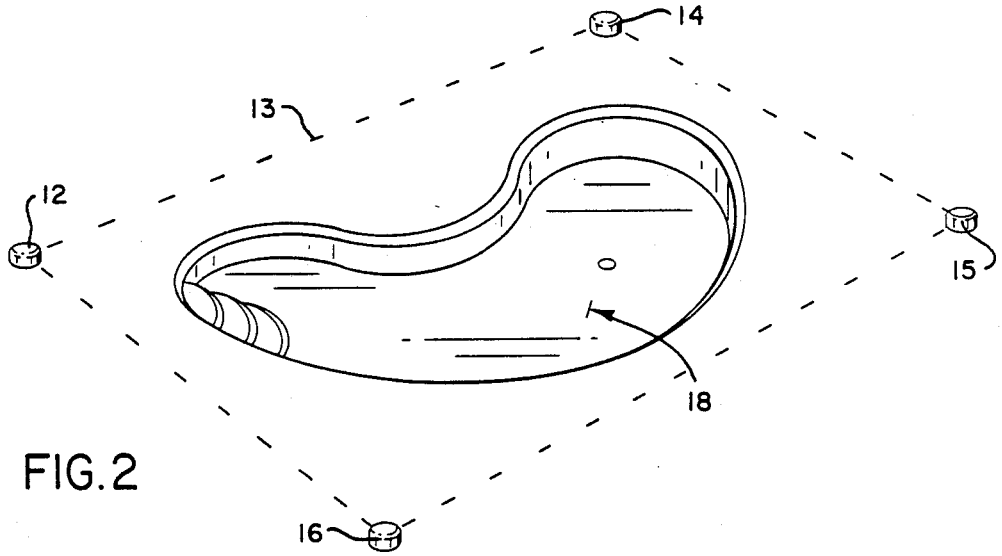
FIG. 2 shows the system of the invention used with an unusual geometry or free-form swimming pool

FIG. 2 shows the application of the present invention to an unusual geometry or so-called "free-form" swimming pool 18. Although there are no straight sides to this pool, the apparatus 12 and corner reflecting units 13–16 are still mounted to the decking 18 outside of the pool and in an arrangement to form a rectangular path. The fact that the straight lines along which the infrared beam moves may be at varying distance from the pool side does not inhibit operation or impair it in any way. It is still advisable with a pool of this shape that the beam be located 2–4 inches above the decking surface for reasons already given. The operation of the invention is identical to that for the more conventional rectangular pool.

As can be seen best in FIG. 5, the IR beam generating and beam detection apparatus is mounted onto the upper surface of a base plate 19 having an integral positioning pin 20 secured to the lower surface of the plate at substantially its center point for a purpose to be described. An infrared light emitter 21 is edge mounted to a gimbal 22 which enables adjustably positioning the beam emitting surface of the emitter 21 in two orthogonal planes. The gimbal has a first generally U-shaped member 23 with its side arms rotatably connected to the emitter 21 via pins 24. The U-shaped member 23, is in turn, rotatably mounted onto a pedestal 25 which is secured to the base plate upper surface. Adjustment of the emitter about the axis of pins 24 is 90 degrees to the rotational axis of the U-shaped member on the pedestal 25, the combined effect giving full positional adjustment for the IR emitter.

The apparatus 12 also includes a photoelectric means such as a solid state IR detector 26, for example, having a planar sensing surface and the edges of which are rotatably mounted within a gimbal 27 which can be of identical construction to the gimbal 22. With the gimbal adjustment centralized, the detector 26 faces outwardly from the base 19 along a direction 90 degrees from the direction that the IR emitter 21 faces when properly adjusted. Also mounted on the same base 19 is a power supply and alarm control logic 28. Still further, an RF transmitter 29 and associated antenna 30 are secured to the upper surface of the base plate 19, the antenna being connected to the transmitter and the transmitter being driven by the emitter/detector power supply and alarm control logic in a way that will be described.

A transparent shell-like cover 31 for the apparatus 12 enables the exciting surface of the IR emitter 21 to emit the IR light beam 13 outwardly and the active parts of the IR detector 26 to receive the beam from reflecting unit 16 irrespective of the emitter and detector.

In assembly, a suitable opening is formed in the deck 11 at a position which forms the corner of a desired rectangular IR beam traversal path with the emitter 21 and detector 26 facing towards the path corners where reflector units 14 and 16 are to be located, respectively. The base plate pin 20 is then positioned in the deck corner opening and the emitter and detector properly located to face along adjacent lines forming a corner of the IR traversal path. Then, one or more bolts 32 are received through the base plate and secured with the deck fixing the entire apparatus 12 against unitary translation or rotation.

Each of the corner reflectors 14 through 16 is identical in construction and therefore only the reflector 14 will be described, it being assumed that for the other two, the same numbered parts will be represented in each. The reflecting means 14 has a base plate 33 of any suitable outline geometry and including a pin 34 integral therewith extending from the base plate lower surface at substantially its center point. One or more openings 35 are formed in the base plate for mounting the reflecting means to a swimming pool deck, as will be described.

Figure 3:
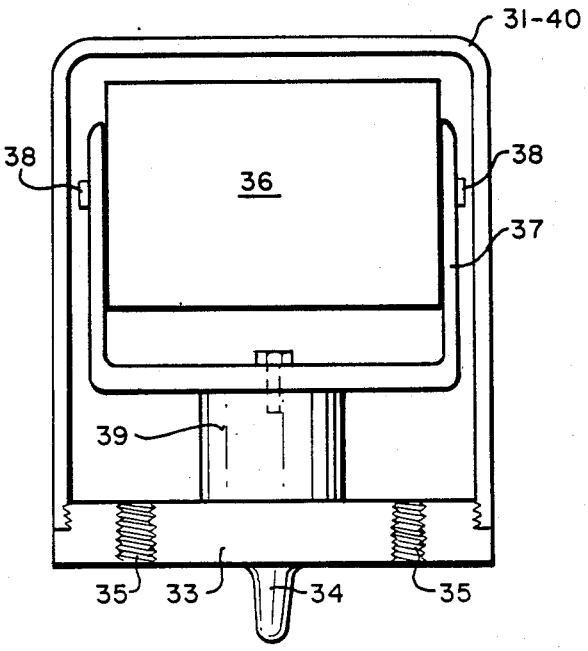
FIG. 3 is an elevational view of a reflecting unit of the present invention.

With reference to FIG. 3, a reflector such as a mirror 36, for example, is mounted within a generally Ushaped gimbal 37 relative to which the mirror is rotatable about an axis defined by two edge connecting pins 38. The gimbal 37 has its cross member affixed to a rotatable pedestal 39 which is substantially centrally located on the upper surface of the base plate 33. By this mounting arrangement, the reflector 36 may be suitably located for directing an IR beam, as will be more particularly described, along a desired path.

Mounting of each of the reflecting means 14 through 16 to the swimming pool deck is similar to the way in which the apparatus 12 already described is mounted. More particularly, an opening is formed at what is determined to be the precise corner of the desired IR path and a pin 34 fitted therein. One or more bolts are then extended from the top side of the base plate 33 downwardly through openings 35 for receipt within other openings in the cement and thereby secure the entire reflecting means against rotation or translation with respect to the deck.

Each reflector unit is enclosed within a cylindrical or cup-shaped transparent cover 40 which can either be snapped or threaded onto the base plate. The transparent wall of the cover 40 allows the reflecting surface of the reflector 36 to receive and reflect light in accordance with the practice of this invention throughout the entire circumferential periphery.

Figure 4:
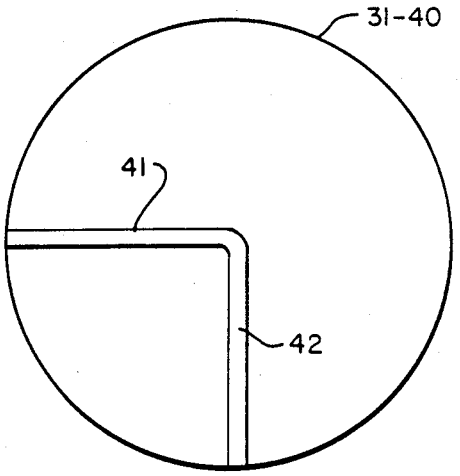
FIG. 4 is a top plan view of the reflecting unit of FIG. 3.

The top wall on the outer surface of the cover 40 includes a molded-in or embossed pair of alignment lines 41, 42 arranged at 90 degrees to each other which serves to assist in initially lining up the reflecting means during mounting to the decking (FIG. 4).

Reference is now made to FIG. 8 which depicts the circuit schematic of the overall apparatus of the invention. A battery power supply 43 (also identified in FIG. 5 as 28) provides the necessary electrical power through a low voltage sensor 44 and main relay 45 to energize the IR emitter 21, IR detector 26, logic 46 (shown combined in FIG. 5 at 28) and the radio frequency transmitter 29. The power supply 43 may be any of a number of different available kinds, but preferably a rechargeable battery. An exceptionally advantageous power supply for present purposes is achieved by connecting a solar array 47 to charge the rechargeable battery power supply. The solar array can be mounted on the top of the apparatus 12 under the transparent cover.

In operation, a remote control unit 48 is activated which sends an RF signal to receiver 49 to enable the main relay 45 and in that way apply electrical power to the various system parts as has been described. The emitter 21 produces an IR beam 13 which as long as it is not interrupted actuates the detector 26 and logic 46 to produce a "down" or zero signal to transmitter 29. When the beam 13 is interrupted by an intruder, for example, there is a corresponding interruption of the IR detector signal which on interpretation by the logic 46 produces an "up" signal to transmitter 29. Energiziation of the transmitter in this way sends a signal to an RF receiver 50 which then actuates the alarm 17. The alarm will continue operating until it is affirmatively reset at 51.

If the biasing voltage of battery power supply 43 becomes too low, the system may not be able to respond to an interrupted IR beam. Accordingly, the low voltage sensor 44 on noting a low voltage condition lights a warning light (LED) 52 and through the logic 46 sets off the alarm 17. When this happens the battery supply 43 must be brought up to proper voltage in order to continue.

I claim:

1. A system for determining the presence of an individual within a predetermined distance of the edge of a swimming pool surrounded by a deck, comprising:

means fixedly mounted to the deck for directing a beam of infrared light along a linear direction generally parallel to the deck;

first, second and third reflecting units fixedly mounted on the deck at separate spaced apart points, said reflecting units being so arranged as to serially reflect the infrared beam in a closed path about the pool of predetermined geometry and dimensions and in a single plane, the last reflection bringing the beam to a point closely adjacent to the means for directing the infrared beam;

means responsive to the infrared beam for producing an electrical signal, the said means being located to interrupt the infrared beam after the last reflection at a point closely adjacent to the means for directing the infrared beam;

base plate means for unitarily mounting the infrared beam directing means and a means responsive to a lack of said electric signal for producing an actuating signal;

a first radio frequency transmitter responsive to the actuating signal for producing an alarm signal;

an alarm receiver means responsive to the alarm signal for producing an alarm drive;

an alarm means responsive to the alarm drive;

a remotely located second radio frequency transmitter;

a second radio frequency receiver tuned to the second transmitter;

a relay actuated by signals received from said second receiver to interconnect an electric supply to the system; and reset means located at the alarm means for selectively turning off the alarm means.

2. A system as in claim 1, in which the electric supply is provided mounted onto the baseplate means including rechargeable battery means and a solar array for charging the same.

3. A system as in claim 1, in which the infrared beam moves along the closed path at a distance from the deck lying within the range of 2–4 inches.

4. A system as in claim 1, in which a low supply voltage sensor interconnects with the electric supply and the means for producing an actuating signal and causes an actuating signal to be produced when the electric supply drops below a predetermined value.

* * * * *